US010522334B2

(12) United States Patent
Kobayashi et al.

(10) Patent No.: US 10,522,334 B2
(45) Date of Patent: Dec. 31, 2019

(54) ELECTRON MULTIPLIER PRODUCTION METHOD AND ELECTRON MULTIPLIER

(71) Applicant: HAMAMATSU PHOTONICS K.K., Hamamatsu-shi, Shizuoka (JP)

(72) Inventors: Hiroshi Kobayashi, Hamamatsu (JP); Ginji Sugiura, Hamamatsu (JP)

(73) Assignee: HAMAMATSU PHOTONICS K.K., Hamamatsu-shi, Shizuoka (JP)

( * ) Notice: Subject to any disclaimer, the term of this patent is extended or adjusted under 35 U.S.C. 154(b) by 0 days.

(21) Appl. No.: 16/321,552

(22) PCT Filed: Aug. 3, 2017

(86) PCT No.: PCT/JP2017/028280
§ 371 (c)(1),
(2) Date: Jan. 29, 2019

(87) PCT Pub. No.: WO2018/043029
PCT Pub. Date: Mar. 8, 2018

(65) Prior Publication Data

US 2019/0164734 A1 May 30, 2019

(30) Foreign Application Priority Data

Aug. 31, 2016 (JP) ..... 2016-169809

(51) Int. Cl.
*H01J 43/24* (2006.01)
*H01J 1/34* (2006.01)
(Continued)

(52) U.S. Cl.
CPC ..... *H01J 43/246* (2013.01); *H01J 1/34* (2013.01); *H01J 9/12* (2013.01); *H01J 43/20* (2013.01)

(58) Field of Classification Search
CPC ..... H01J 43/246; H01J 43/20; H01J 43/22; H01J 1/34; H01J 9/12; H01J 1/32
See application file for complete search history.

(56) References Cited

U.S. PATENT DOCUMENTS 3,244,922 A 4/1966 Wolfgang
5,367,218 A 11/1994 Comby
(Continued)

FOREIGN PATENT DOCUMENTS

JP S46-005767 12/1971
JP S50-115970 A 9/1975
(Continued)

OTHER PUBLICATIONS

International Preliminary Report on Patentability dated Mar. 14, 2019 for PCT/JP2017/028280.

*Primary Examiner* — Anne M Hines
(74) *Attorney, Agent, or Firm* — Drinker Biddle & Reath LLP

(57) ABSTRACT

An electron multiplier production method including a main body portion, and a channel provided in the main body portion to open at one end surface and the other end surface of the main body portion and emits secondary electrons includes a first step of preparing a main body member including the one end surface and the other end surface, a communicating hole for the channel through which the one end surface and the other end surface communicate being provided in the main body member, a second step of forming the channel by forming a deposition layer including at least a resistive layer on an outer surface of the main body member and an inner surface of the communicating hole using an atomic layer deposition method, and a third step of forming the main body portion by removing the deposition layer formed on the outer surface of the main body member.

21 Claims, 13 Drawing Sheets

(51) Int. Cl.
*H01J 9/12* (2006.01)
*H01J 43/20* (2006.01)

(56) References Cited

U.S. PATENT DOCUMENTS

| | | | | |
|---|---|---|---|---|
| 5,581,151 | A | 12/1996 | Wheeler et al. | |
| 8,227,965 | B2 * | 7/2012 | Sullivan | H01J 43/04 313/103 CM |
| 9,892,892 | B2 * | 2/2018 | Suyama | H01J 9/125 |
| 10,340,129 | B2 * | 7/2019 | Nagata | H01J 43/24 |

FOREIGN PATENT DOCUMENTS

| | | | |
|---|---|---|---|
| JP | H02-297857 | A | 12/1990 |
| JP | H03-116626 | A | 5/1991 |
| JP | 2011-513921 | A | 4/2011 |
| JP | 2011-525294 | A | 9/2011 |
| WO | WO-2009/148643 | A2 | 12/2009 |
| WO | WO-2010/036429 | A2 | 4/2010 |
| WO | WO-2014/050260 | A1 | 4/2014 |

* cited by examiner

ELECTRON MULTIPLIER PRODUCTION METHOD AND ELECTRON MULTIPLIER

TECHNICAL FIELD

An aspect of the present invention relates to an electron multiplier production method and an electron multiplier.

BACKGROUND ART

Patent Literature 1 describes a channel electron multiplier (CEM). This CEM includes a substrate, and a channel that is provided in the substrate to open at a surface of one end portion and a surface of the other end portion of the substrate and emits secondary electrons according to incident electrons. In addition, Patent Literature 1 discloses forming an electron emission layer on the substrate using an atomic layer deposition method in order to improve secondary electron emission efficiency.

Patent Literature 2 describes a microchannel plate (MCP). This MCP includes a substrate, and a number of millions of channels that are provided in the substrate to open at an upper surface and a lower surface of the substrate and emit secondary electrons according to incident electrons. Further, Patent Literature 2 discloses that a resistive layer having a structure in which a conductive material and an insulating material are stacked is formed on the substrate using an atomic layer deposition method so that a resistance value of the resistive layer becomes an optimal value.

CITATION LIST

Patent Literature

[Patent Literature 1] Japanese Unexamined Patent Publication No. 2011-513921

[Patent Literature 2] Japanese Unexamined Patent Publication No. 2011-525294

SUMMARY OF INVENTION

Technical Problem

At the time of an operation of the CEM described in Patent Literature 1, an acceleration voltage is applied to the CEM. Accordingly, electrons traveling inside the channel are accelerated and collide with the resistive layer, and as a result, the secondary electrons are amplified and emitted. Subsequently, the emitted secondary electrons are accelerated by the acceleration voltage and collide with the resistive layer, and new secondary electrons are further amplified and emitted. This is then repeated.

In the CEM, the present inventors have found that the following problems may occur. That is, in the CEM, in order to improve the secondary electron emission efficiency, it is sufficient to form the resistive layer only on an inner surface of the channel. However, for example, when the atomic layer deposition method is used for formation of the resistive layer, the resistive layer is formed on an entire surface of the substrate. That is, the resistive layer is formed not only on the inner surface of the channel but also on an outer surface of the substrate.

Therefore, when the acceleration voltage is applied to the CEM at the time of the operation of the CEM, a potential difference also occurs in the resistive layer formed on the outer surface of the substrate and a current flows in the resistive layer. Therefore, there is concern that Joule heat may be generated in the resistive layer formed on the outer surface of the substrate, and a temperature of the entire CEM may rise.

It should be noted that the present inventors have also obtained the following knowledge regarding the MCP. That is, in the MCP described in Patent Literature 2, a resistive layer is also formed on an outer surface of the substrate using the atomic layer deposition method. However, in the MCP, since a surface area of the outer surface of the substrate is much smaller than that of the channel, a current flowing in the outer surface of the substrate is extremely low. Thus, the above-described problem occurring in the CEM hardly occurs.

An object of an aspect of the present invention is to provide an electron multiplier production method capable of suppressing a rise in temperature, and the an electron multiplier.

Solution to Problem

An aspect of the present invention has been made as a result of intensive examination by the present inventors based on the above findings. That is, an electron multiplier production method according to an aspect of the present invention is an electron multiplier production method including a main body portion, and a channel that is provided in the main body portion to open at one end surface and the other end surface of the main body portion and emits secondary electrons according to incident electrons, the method including: a first step of preparing a main body member including the one end surface and the other end surface, a communicating hole for the channel through which the one end surface and the other end surface communicate being provided in the main body member; a second step of forming the channel by forming at least a resistive layer on an outer surface of the main body member and an inner surface of the communicating hole using an atomic layer deposition method; and a third step of forming the main body portion by removing the resistive layer formed on the outer surface of the main body member.

In this electron multiplier production method, the channel is formed by forming a deposition layer including at least the resistive layer on the outer surface of the main body member for the main body portion and the inner surface of the communicating hole for the channel using the atomic layer deposition method. Then, the main body portion is formed by removing the deposition layer formed on the outer surface of the main body member. Therefore, even when a potential difference is applied between the one end surfaces and the other end surface at the time of an operation of the electron multiplier, a current is prevented from flowing to the outer surface of the main body portion via the resistive layer. Therefore, heat generation on the outer surface of the main body portion is suppressed. Accordingly, in the electron multiplier produced using such a method, it is possible to resolve the above problem and suppress a rise in temperature.

In the electron multiplier production method according to an aspect of the present invention, the second step may include forming the deposition layer including the resistive layer and a secondary electron multiplication layer stacked on the resistive layer. In this case, it is possible to remove the deposition layer including the secondary electron multiplication layer from the outer surface while efficiently forming the deposition layer including the secondary electron multiplication layer.

In the electron multiplier production method according to an aspect of the present invention, the main body member may be formed of an insulating material. In this case, since it is difficult for a current to flow through the main body portion itself, the operation and effects obtained by removing the resistive layer become more effective.

In the electron multiplier production method according to an aspect of the present invention, the third step may include removing the deposition layer through sandblasting. In this case, it is possible to appropriately remove the deposition layer at a desired place (the outer surface) on the main body member by using sandblasting.

In the electron multiplier production method according to an aspect of the present invention, the outer surface of the main body member may include the one end surface, the other end surface, and a side surface connecting the one end surface to the other end surface, and the third step may include removing the deposition layer formed on the side surface while maintaining the deposition layer formed on the one end surface and the other end surface. In this case, since it is unnecessary to perform a process of removing the deposition layer on the one end surface and the other end surface at which the channels are open, an influence of the removal process on the channels can be reduced.

The electron multiplier production method according to an aspect of the present invention may further include a fourth step of thermally connecting a heat sink to the outer surface of the main body portion after the third step. In this case, it is possible to cool the main body portion using the heat sink. Further, since at least the resistive layer is not interposed between the outer surface of the main body portion and the heat sink, an influence of a potential difference applied between the one end surface and the other end surface of the main body portion on the heat sink can be reduced.

In the electron multiplier production method according to an aspect of the present invention, the heat sink may be formed of a metal, and the fourth step may include bringing the heat sink into contact with the outer surface. As described above, since at least the resistive layer is not interposed between the outer surface of the main body portion and the heat sink, there is no concern that a current will flow through the heat sink due to an influence of the potential difference applied between the one end surfaces and the other end surface of the main body portion. Therefore, it is possible to efficiently cool the main body portion by bringing the heat sink formed of a metal into contact with the outer surface of the main body portion.

An electron multiplier according to an aspect of the present invention includes a main body portion including one end surface, the other end surface, and a side surface connecting the one end surface to the other end surface; and a channel provided in the main body portion to be open at the one end surface and the other end surface, wherein the channel includes a deposition layer including a resistive layer and a secondary electron multiplication layer formed on an inner surface of a communicating hole for the channel, the deposition layer is formed on the one end surface and the other end surface, the side surface is exposed at least from the resistive layer, and the deposition layer is formed using an atomic layer deposition method.

In this electron multiplier, the side surface of the main body portion is exposed at least from the resistive layer (that is, the resistive layer is not formed on the side surface). Therefore, even when a potential difference is applied between the one end surfaces and the other end surface at the time of an operation of the electron multiplier, a current is prevented from flowing to the outer surface of the main body portion via the resistive layer. Therefore, heat generation on the outer surface of the main body portion is suppressed. Accordingly, in this electron multiplier, it is possible to resolve the above problem and suppress a rise in temperature. It should be noted that the secondary electron multiplication layer may be formed on the side surface.

Advantageous Effects of Invention

According to the aspect of the present invention, it is possible to provide an electron multiplier production method capable of suppressing a rise in temperature, and the electron multiplier.

DESCRIPTION OF EMBODIMENTS

Figure 1:
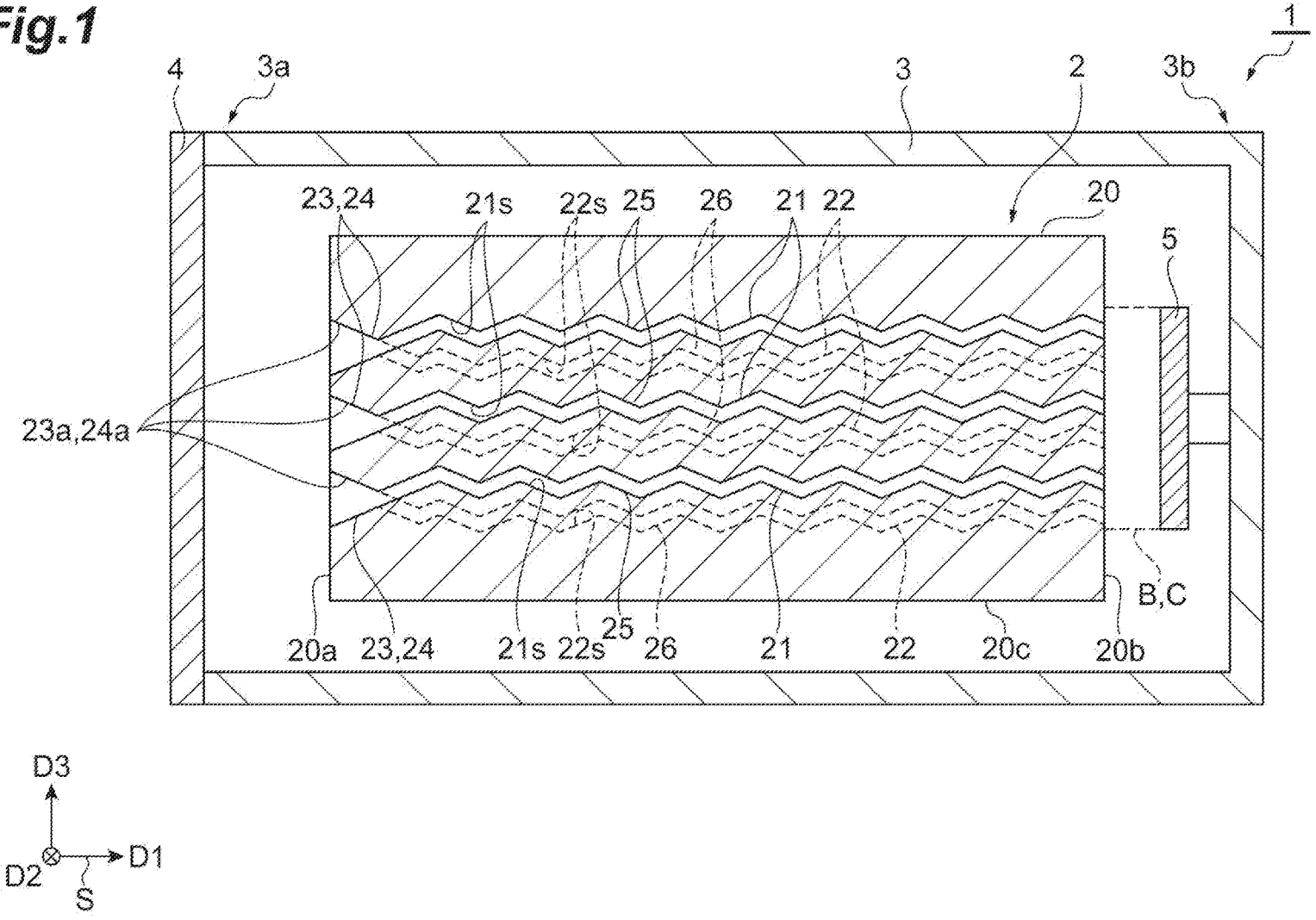
FIG. 1 is a schematic cross-sectional view of a photomultiplier tube according to an embodiment.

Hereinafter, an embodiment of an aspect of the present invention will be described in detail with reference to the drawings. It should be noted that in each drawing, the same or equivalent elements are denoted by the same reference numerals, and repeated description thereof may be omitted. In addition, in each drawing, a cartesian coordinate system S defining a first direction D1, a second direction D2, and a third direction D3 may be shown.

Figure 2:
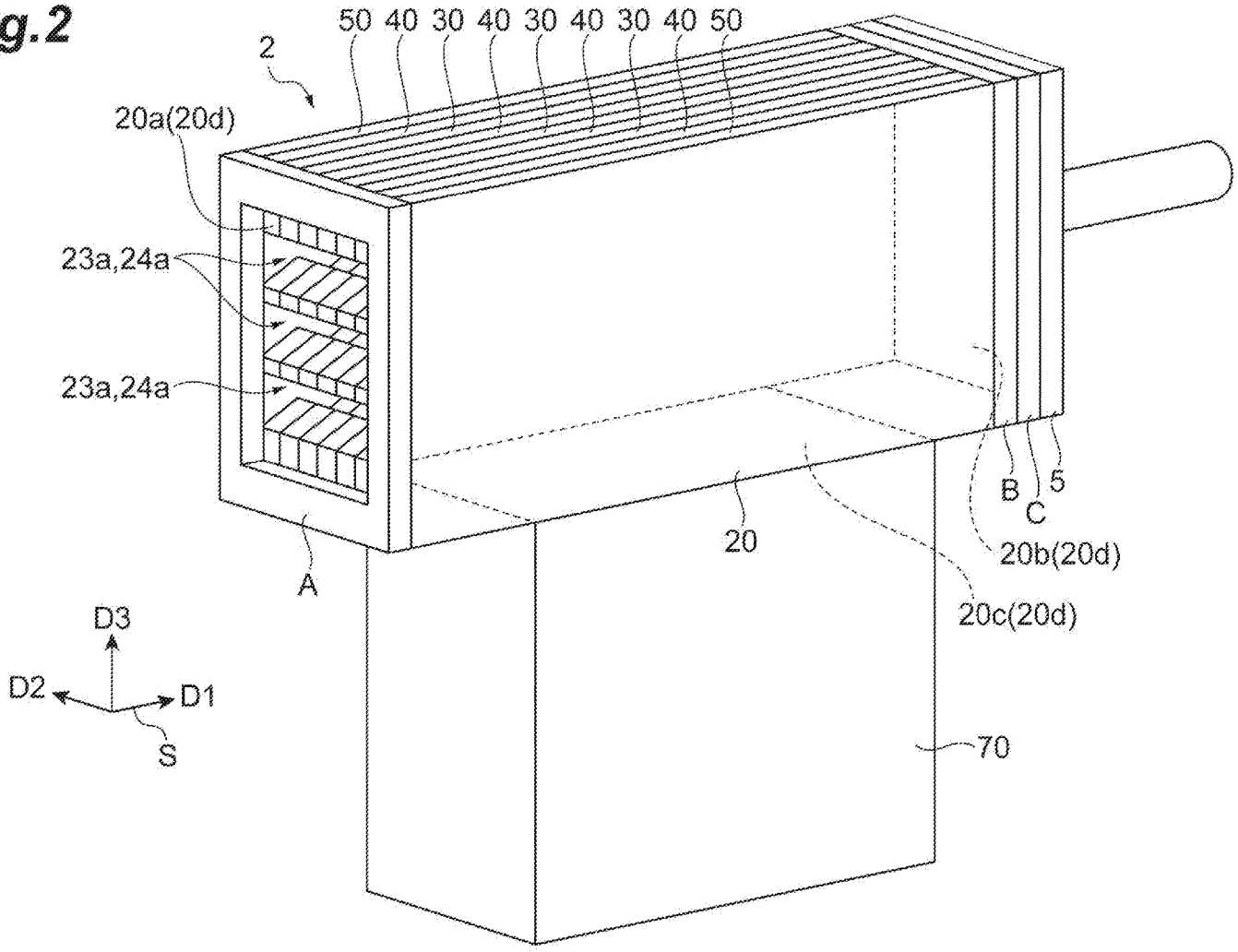
FIG. 2 is a perspective view of an electron multiplier illustrated in FIG. 1.
Figure 3:
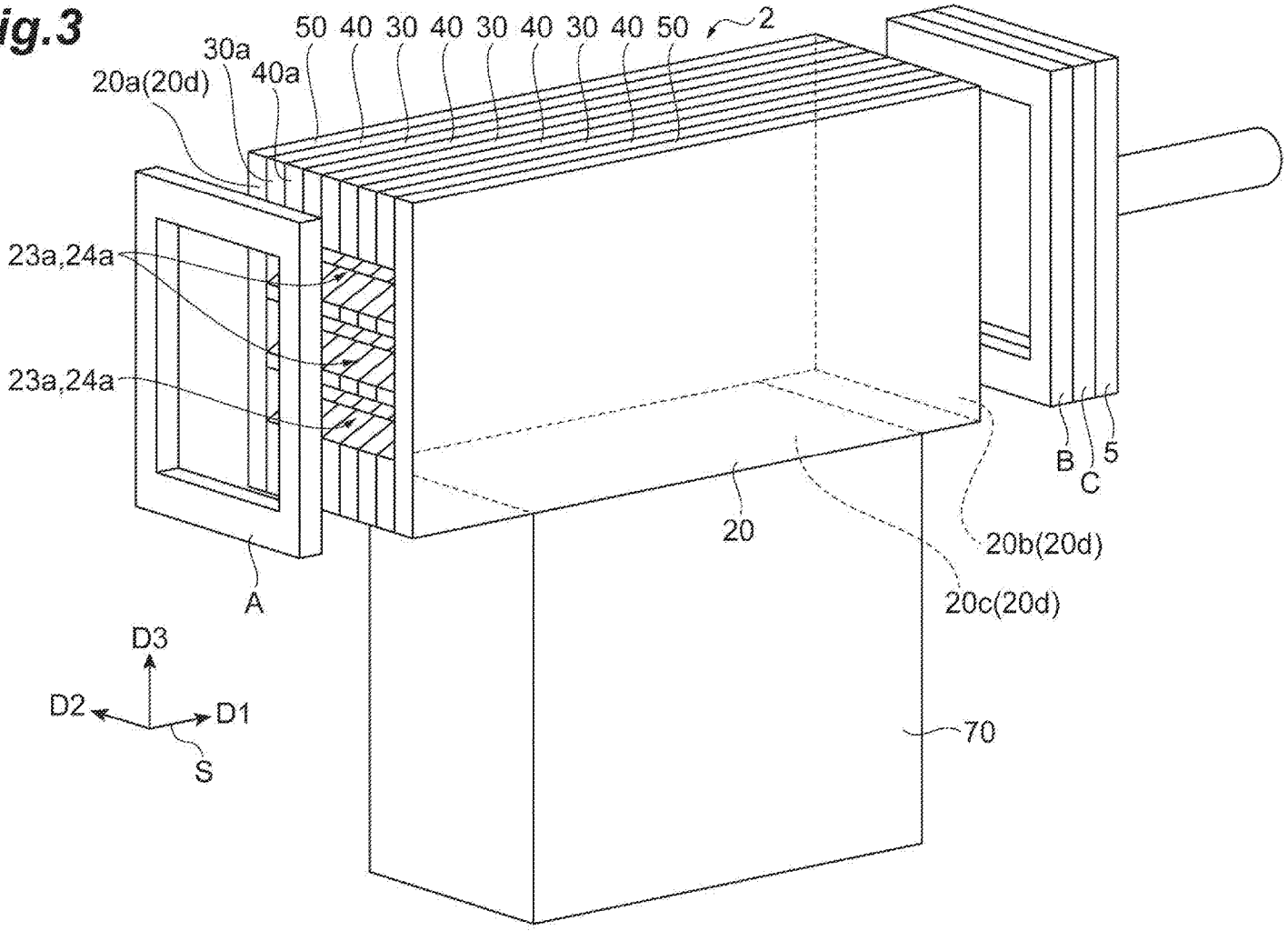
FIG. 3 is a perspective view of the electron multiplier illustrated in FIG. 1.

FIG. 1 is a schematic sectional view of a photomultiplier tube according to the present embodiment. FIGS. 2 and 3 are perspective views of an electron multiplier illustrated in FIG. 1.

As illustrated in FIGS. 1 to 3, the photomultiplier tube 1 includes an electron multiplier (a channel electron multiplier CEM) 2, a tube body 3, a photoelectric surface 4, and an anode 5. The electron multiplier 2 includes a rectangular parallelepiped main body portion 20 extending in the first direction D1. The main body portion 20 includes, for example, an insulating material such as a ceramic. An outer surface 20*d* of the main body portion 20 includes an end surface (one end surface) 20*a* in the first direction D1, an end surface (the other end surface) 20*b* opposite to the end surface 20*a* in the first direction D1, and a side surface 20*c* that connects the end surface 20*a* to the end surface 20*b*.

A rectangular annular input electrode A along an outer edge of the end surface 20*a* is provided on the end surface 20*a*. A rectangular annular output electrode B along an outer edge of the end surface 20*b* is provided on the end surface 20*b*. A potential difference in the first direction D1 is applied to the entire main body portion 20 by the input electrode A and the output electrode B so that the end surface 20*b* is brought to a relatively higher potential than the end surface 20*a*.

The electron multiplier 2 includes a plurality of first channels (a channel) 21 and a plurality of second channels (a channel) 22. That is, the photomultiplier tube 1 and the electron multiplier 2 are multi-channeled. The first channel 21 and the second channel 22 are open to the end surfaces 20*a* and 20*b* of the main body portion 20. That is, the first channel 21 and the second channel 22 extend from the end surface 20*a* to the end surface 20*b* of the main body portion 20.

The first channel 21 includes an electron incidence portion 23 and an electron multiplication portion 25. The electron incidence portion 23 includes an opening portion 23*a* that opens to the end surface 20*a*. The electron incidence portion 23 is connected to the electron multiplication portion 25 at an end portion opposite to the opening portion 23*a*. The electron multiplication portion 25 extends in the first direction D1 from a portion for connection to the electron incidence portion 23, reaches the end surface 20*b*, and is open to the end surface 20*b*. The first channel 21 emits secondary electrons in the electron multiplication portion 25 according to electrons incident from the electron incidence portion 23.

The second channel 22 includes an electron incidence portion 24 and an electron multiplication portion 26. The electron incidence portion 24 includes an opening portion 24*a* that opens to the end surface 20*a*. The electron incidence portion 24 is connected to the electron multiplication portion 26 at an end portion opposite to the opening portion 24*a*. The electron multiplication portion 26 extends in the first direction D1 from a portion for connection to the electron incidence portion 24, reaches the end surface 20*b*, and is open to the end surface 20*b*. The second channel 22 emits secondary electrons in the electron multiplication portion 26 according to electrons incident from the electron incidence portion 24.

The first channel 21 and the second channel 22 overlap each other at the electron incidence portion 23 and the electron incidence portion 24 in the second direction D2 (a stacking direction of a plate-shaped member to be described below, which is a direction crossing (orthogonal to) the first direction D1), and do not overlap each other at the electron multiplication portion 25 and the electron multiplication portion 26 (are spaced from each other in the third direction D3). It should be noted that the third direction D3 is a direction crossing (orthogonal to) the first direction D1 and the second direction D2.

The tube body 3 accommodates the electron multiplier 2. One end portion 3*a* of the tube body 3 in the first direction D1 is open and the other end portion 3*b* is sealed. The electron multiplier 2 is accommodated in the tube body 3 so that the end surface 20*a* of the main body portion 20 is located on the side of the end portion 3*a* of the tube body 3.

The photoelectric surface 4 generates photoelectrons according to incidence of light. The photoelectric surface 4 is provided on the tube body 3 to face the opening portion (opening) 23*a* of the first channel 21 and the opening portion (opening) 24*a* of the second channel 22 in the end surface 20*a*. Here, the photoelectric surface 4 is provided on the tube body 3 to seal the end portion 3*a* of the tube body 3. The photoelectric surface 4 supplies the photoelectrons to the first channel 21 and the second channel 22 via the electron incidence portions 23 and 24.

The anode 5 is arranged inside the tube body 3 to face the openings of the first channel 21 and the second channel 22 (the openings of the electron multiplication portions 25 and 26) in the end surface 20*b*. Here, the anode 5 is attached to the output electrode B via an insulating layer C having a rectangular annular shape. A central portion of the anode 5 is exposed from opening portions of the output electrode B and the insulating layer C and faces the openings of the first channel 21 and the second channel 22. With such a configuration, the anode 5 receives the secondary electrons emitted from the first channel 21 and the second channel 22 via the electron multiplication portions 25 and 26. A detector (not illustrated) that detects pulses of an electrical signal corresponding to the secondary electrons received by the anode 5, for example, is connected to the anode 5.

Figure 4:
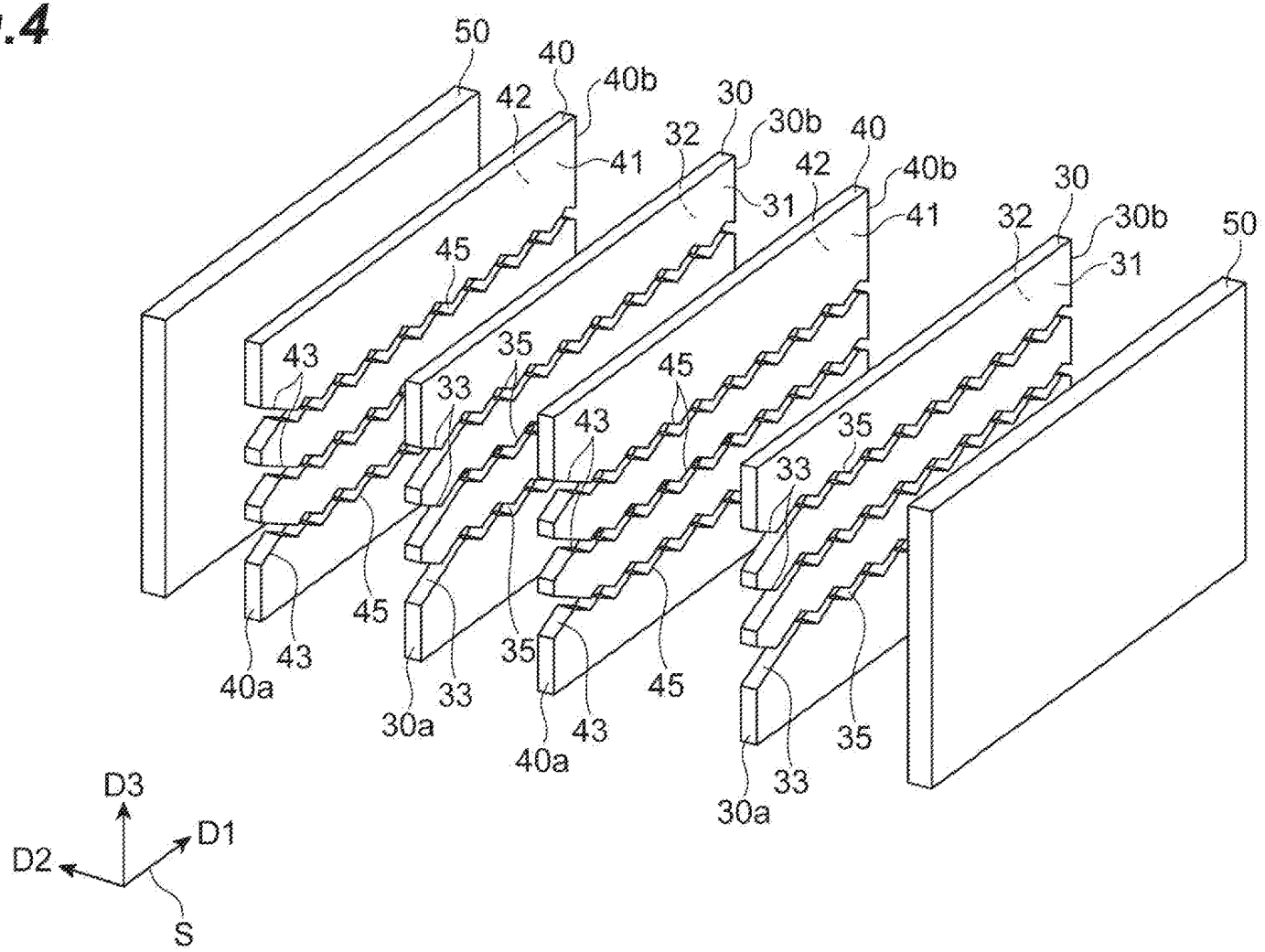
FIG. 4 is an exploded perspective view of the electron multiplier illustrated in FIGS. 2 and 3.

Here, FIG. 4 is an exploded perspective view of the electron multiplier illustrated in FIGS. 2 and 3. As illustrated in FIGS. 2 to 4, the main body portion 20 of the electron multiplier 2 is configured by stacking a plurality of plate-shaped members. Here, the main body portion 20 includes a plurality of first plate-shaped members 30, a plurality of second plate-shaped members 40, and a pair of third plate-shaped members 50, which are stacked on each other in the second direction D2. The first plate-shaped members 30, the second plate-shaped members 40, and the third plate-shaped members 50 form the first channel 21 and the second channel 22. The number of first plate-shaped members 30 and second plate-shaped members 40 can be arbitrarily set according to the number of required channels and is, for example, about two to four.

The first plate-shaped member 30 and the second plate-shaped member 40 are alternately stacked in the second direction D2. The third plate-shaped members 50 are stacked together with the first plate-shaped members 30 and the second plate-shaped members 40 to sandwich the stack of first plate-shaped members 30 and second plate-shaped members 40 from both sides in the second direction D2. Therefore, some of the plurality of first plate-shaped members 30 can be arranged between pairs of second plate-shaped members 40 and another can be arranged between the second plate-shaped member 40 and the third plate-shaped member 50. Further, some of the plurality of second plate-shaped members 40 can be arranged between pairs of first plate-shaped members 30 and another can be arranged between the first plate-shaped member 30 and the third plate-shaped member 50. Aspects of the arrangement of the first plate-shaped members 30 and the second plate-shaped members 40 differ according to the number of first plate-shaped members 30 and second plate-shaped members 40, for example.

In the example of FIG. 4, one first plate-shaped member 30 on the center side in the second direction D2 among the two first plate-shaped members 30 is arranged between the pair of second plate-shaped members 40, and one first plate-shaped member 30 on the outer side in the second direction D2 among the two first plate-shaped members 30 is arranged between the second plate-shaped member 40 and the third plate-shaped member 50. Further, in the example of FIG. 4, one second plate-shaped member 40 on the center side in the second direction D2 among the two second plate-shaped members 40 is arranged between the pair of first plate-shaped members 30, and one second plate-shaped member 40 on the outer side in the second direction D2 among the two second plate-shaped members 40 is arranged between the first plate-shaped member 30 and the third plate-shaped member 50.

Figure 5:
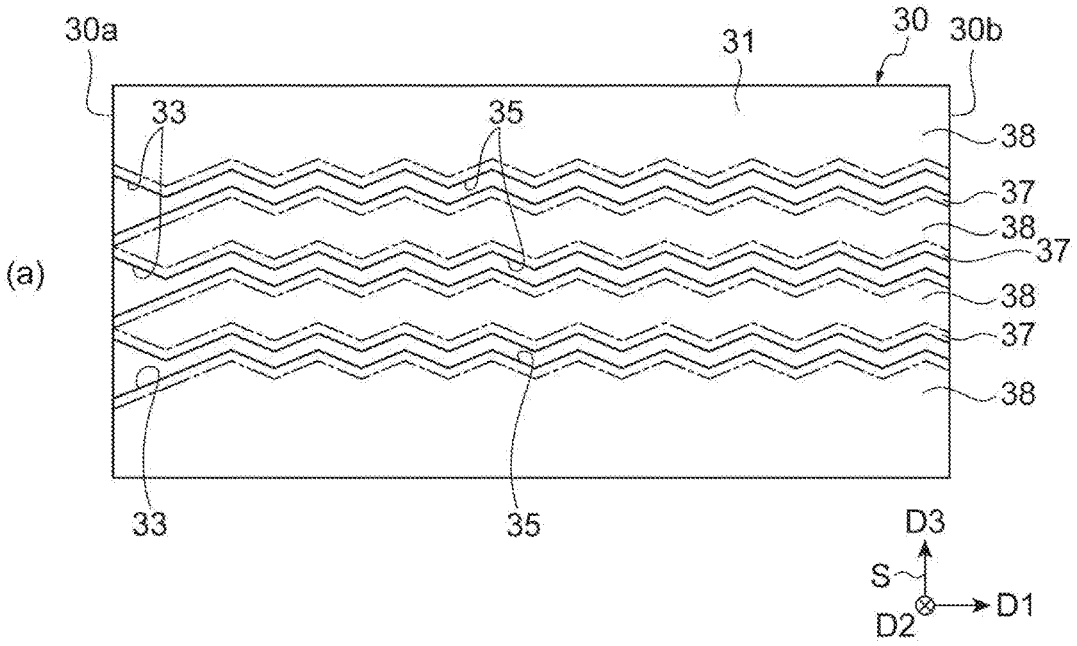
FIG. 5 is a plan view of a first plate-shaped member and a second plate-shaped member illustrated in FIG. 4.
Figure 5:
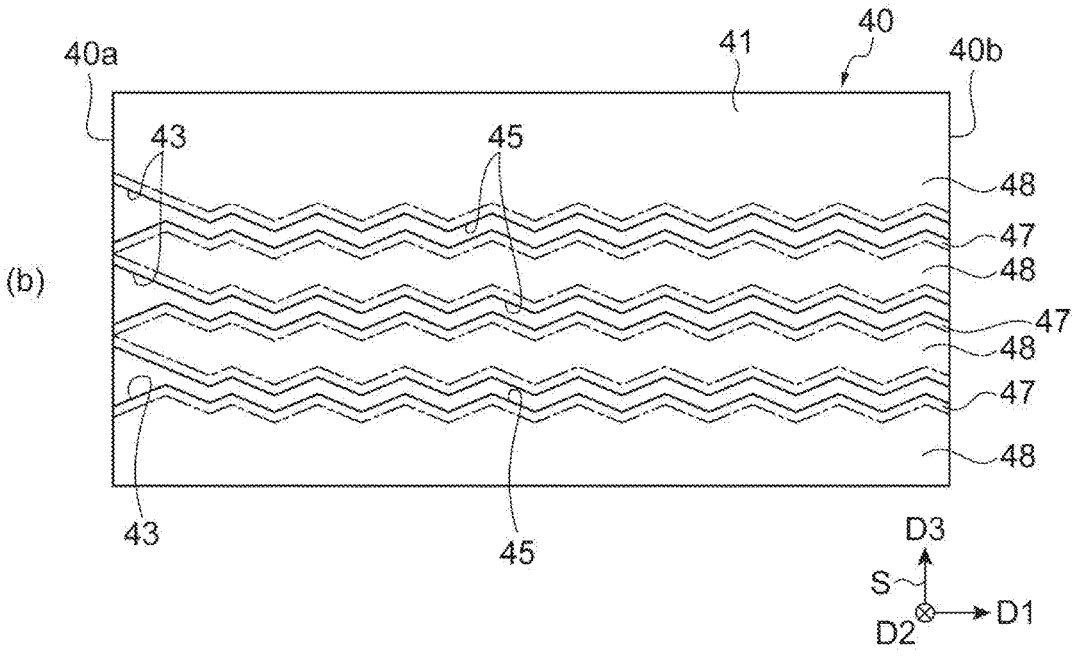

FIG. 5 is a plan view of the first plate-shaped member and the second plate-shaped member illustrated in FIG. 4. As illustrated in FIGS. 4 and 5, the first plate-shaped member 30, the second plate-shaped member 40, and the third plate-shaped member 50 have a rectangular plate shape of which a longitudinal direction is the first direction D1 and a thickness direction is the second direction D2. The first plate-shaped member 30 includes a front surface (a first front surface) 31 and a back surface (a first back surface) 32 that intersect with the second direction D2. In the first plate-shaped member 30, holes defining the first channels 21 are formed.

More specifically, in the first plate-shaped member 30, a hole portion (a third hole portion) 33 and a hole portion (a first hole portion) 35 reaching the back surface 32 from the front surface 31 are formed. The hole portion 33 reaches the end surface 30*a* of the first plate-shaped member 30 in the first direction D1. The hole portion 33 has a tapered shape that decreases in size in the first direction D1 from the end surface 30*a*. The hole portion 33 is connected to the hole portion 35. The hole portion 35 extends in a wave shape in the first direction D1 from a portion for connection to the hole portion 33 and reaches the end surface 30*b* of the first plate-shaped member 30 in the first direction D1.

The end surface 30*a* is a surface on which the end surface 20*a* of the main body portion 20 is formed. The end surface 30*b* is a surface on which the end surface 20*b* of the main body portion 20 is formed. Therefore, the hole portion 33 corresponds to the electron incidence portion 23 of the first channel 21 (defines the electron incidence portion 23), and the hole portion 35 corresponds to the electron multiplication portion 25 of the first channel 21 (defines the electron multiplication portion 25).

Here, a plurality (three in this case) of hole portions 33 and 35 arranged in the third direction D3 are formed in the first plate-shaped member 30. An area between the hole portions 35 in the first plate-shaped member 30 and an area outside the hole portion 35 are solid. That is, the first plate-shaped member 30 includes a plurality of hole portion areas (first hole portion areas) 37 in which the hole portions 35 are formed and a plurality of solid areas (first solid areas) 38 adjacent to the hole portion areas 37. Here, the hole portion area 37 has a shape along the hole portion 35. In addition, here, the solid area 38 has a shape complementary to the hole portion 35. The hole portion areas 37 and the solid areas 38 are alternately arranged in the third direction D3.

The second plate-shaped member 40 includes a front surface (a second front surface) 41 and a back surface (a second back surface) 42 that intersect with the second direction D2. Holes defining the second channels 22 are formed in the second plate-shaped member 40. More specifically, a hole portion (a fourth hole portion) 43 and a hole portion (a second hole portion) 45 reaching the back surface 42 from the front surface 41 are formed in the second plate-shaped member 40. The hole portion 43 reaches an end surface 40*a* of the second plate-shaped member 40 in the first direction D1. The hole portion 43 has a tapered shape that decreases in size in the first direction D1 from the end surface 40*a*. The hole portion 43 is connected to the hole portion 45.

The hole portion 45 extends in a wave shape in the first direction D1 from a portion for the connection with the hole portion 43 and reaches the end surface 40*b* of the second plate-shaped member 40 in the first direction D1. The end surface 40*a* is a surface on which the end surface 20*a* of the main body portion 20 is formed. The end surface 40*b* is a surface on which the end surface 20*b* of the main body portion 20 is formed. Therefore, the hole portion 43 corresponds to the electron incidence portion 24 of the second channel 22 (defines the electron incidence portion 24), and the hole portion 45 corresponds to the electron multiplication portion 26 of the second channel 22 (defines the electron multiplication portion 26).

Here, a plurality (three in this case) of hole portions 43 and 45 arranged in the third direction D3 are formed in the second plate-shaped member 40. An area between the hole portions 45 in the second plate-shaped member 40 and an area outside the hole portion 45 are solid. That is, the second plate-shaped member 40 includes a plurality of hole portion areas (second hole portion areas) 47 in which the hole portions 45 are formed, and a plurality of solid areas (second solid areas) 48 adjacent to the hole portion areas 47. Here, the hole portion area 47 has a shape along the hole portion 45. In addition, here, the solid area 48 has a shape complementary to the hole portion 45. The hole portion areas 47 and the solid areas 48 are alternately arranged in the third direction D3. It should be noted that, a boundary of each area indicated by a single dot-dashed line in FIG. 5 is a virtual one.

The hole portion area 37 of the first plate-shaped member 30 faces the solid area 48 of the second plate-shaped member 40 in the second direction D2. The hole portion area 47 of the second plate-shaped member 40 faces the solid area 38 of the first plate-shaped member 30 in the second direction D2. That is, when viewed in the second direction D2, the hole portion 35 and the hole portion 45 do not overlap each other (the hole portion 35 and the hole portion 45 are spaced from each other in the third direction D3). Therefore, the opening in the second direction D2 of the hole portion 35 of the first plate-shaped member 30 is closed by the solid areas 48 of a pair of second plate-shaped members 40 or closed by the solid area 48 of the second plate-shaped member 40 and the third plate-shaped member 50.

Further, the opening in the second direction D2 of the hole portion 45 of the second plate-shaped member 40 is closed by the solid areas 38 of a pair of first plate-shaped members 30 or is closed by the solid area 38 of the first plate-shaped member 30 and the third plate-shaped member 50. Further, the openings of the hole portions 33 and 43 in the second direction D2 are continuous between the plurality of first plate-shaped members 30 and the second plate-shaped members 40 and are closed by a pair of third plate-shaped members 50.

Therefore, the first channel 21 (the electron multiplication portion 25 in this case) is formed to include at least an inner surface of the hole portion 35 and a surface facing the inside of the hole portion 35 in the solid area 48. More specifically, the first channel 21 on the center side of the main body portion 20 in the second direction D2 is formed of the inner surface of the hole portion 35 and the surface facing the inside of the hole portion 35 in a pair of solid areas 48.

Further, the first channel 21 on the outer side of the main body portion 20 in the second direction D2 is formed of the inner surface of the hole portion 35, the surface facing the inside of the hole portion 35 in the solid area 48, and the surface facing the inside of the hole portion 35 in the third plate-shape member 50.

Further, the second channel 22 (the electron multiplication portion 26 in this case) is formed to include at least an inner surface of the hole portion 45 and a surface facing the inside of the hole portion 45 in the solid area 38. More specifically, the second channel 22 on the center side of the main body portion 20 in the second direction D2 is formed of the inner surface of the hole portion 45 and the surface facing the inside of the hole portion 45 in a pair of solid areas 38. Further, the second channel 22 on the outer side of the main body portion 20 in the second direction D2 is formed of the inner surface of the hole portion 45, the surface facing the inside of the hole portion 45 in the solid area 38, and the surface facing the inside of the hole portion 45 in the third plate-shape member 50.

Here, the main body portion 20 includes the plurality of first plate-shaped members 30 and second plate-shaped members 40 arranged in the second direction D2, as described above. The plurality of hole portions 33 and 35 arranged in the third direction D3 are formed in the first plate-shaped member 30. The plurality of hole portions 43 and 45 arranged in the third direction D3 are formed in the second plate-shaped member 40. Therefore, the electron multiplier 2 includes a plurality of channels (the first channels 21 and the second channels 22) arranged two-dimensionally in the second direction D2 and the third direction D3.

Here, the inner surface of the hole portion 35, the surface facing the inside of the hole portion 35 in the solid area 48, and the surface facing the inside of the hole portion 35 in the third plate-shaped member 50 form an inner surface 21*s* of the first channel 21 (see FIG. 1). Further, the inner surface of the hole portion 45, the surface facing the inside of the hole portion 45 in the solid area 38, and the surface facing the inside of the hole portion 45 in the third plate-shaped member 50 form an inner surface 22*s* of the second channel 22 (see FIG. 1). The first channel 21 and the second channel 22 include a resistive layer and a secondary electron multiplication layer stacked on each other, as will be described below. In other words, the first channel 21 includes a deposition layer including a resistive layer and a secondary electron multiplication layer formed on an inner surface 81*s* of a first communicating hole 81 for the first channel 21, as will be described below. Further, the second channel 22 includes a deposition layer including a resistive layer and a secondary electron multiplication layer formed on an inner surface 82*s* of a second communicating hole 82 for the second channel 22. Surface layers of the first channel 21 and the second channel 22 are the secondary electron multiplication layers. Therefore, the inner surface 21*s* and the inner surface 22*s* are surfaces of the secondary electron multiplication layer.

As a material of the resistive layer, for example, a film of a mixture of $Al_2O_3$ (aluminum oxide) and ZnO (zinc oxide), a film of a mixture of $Al_2O_3$ and $TiO_2$ (titanium dioxide), or the like can be used. Further, as a material of the secondary electron multiplication layer, for example, $Al_2O_3$, MgO (magnesium oxide), or the like can be used. The deposition layer including the resistive layer and the secondary electron multiplication layer are formed using atomic layer deposition (ALD).

Here, in order to specify a structure or characteristics of the deposition layer (the resistive layer and secondary electron multiplication layer) (hereinafter referred to as an "ALD film" in this paragraph) formed using an atomic layer deposition method, it is necessary to analyze a surface state of the ALD film. However, a device capable of specifically analyzing a surface state of an ALD film formed on a structure with a high aspect ratio such as the electron multiplier 2 is not known at the present time, and it is difficult to analyze a stacked structure of the ALD film itself. Thus, since it is technically impossible or impractical (unrealistic) to analyze the structure or characteristics of the ALD film at the time of filing, it may be impossible or impractical to directly specifying the ALD film according to the structure or the characteristics in the electron multiplier 2.

On the other hand, a deposition layer (a resistive layer and a secondary electron multiplication layer) is not provided at least on a part of the outer surface 20*d* of the main body portion 20. As an example, at least the resistive layer (and, in this case, the secondary electron multiplication layer) is not provided on the side surface 20*c* connecting the end surface 20*a* to the end surface 20*b* in the main body portion 20. In other words, the side surface 20*c* is exposed at least from the resistive layer (and, in this case, the secondary electron multiplication layer) (that is, a surface formed of the insulating material is exposed). A heat sink 70 is thermally connected to the side surface 20*c* (the outer surface 20*d*) of the main body portion 20 (see FIGS. 2 and 3). Here, the heat sink 70 is in contact with the side surface 20*c* of the main body portion 20. Further, the heat sink 70 is thermally connected to, for example, a flange (not illustrated) for sealing the tube body 3. Accordingly, the heat sink 70 thermally connects the main body portion 20 to the flange. The heat sink 70 is formed of, for example, a metal.

Figure 6:
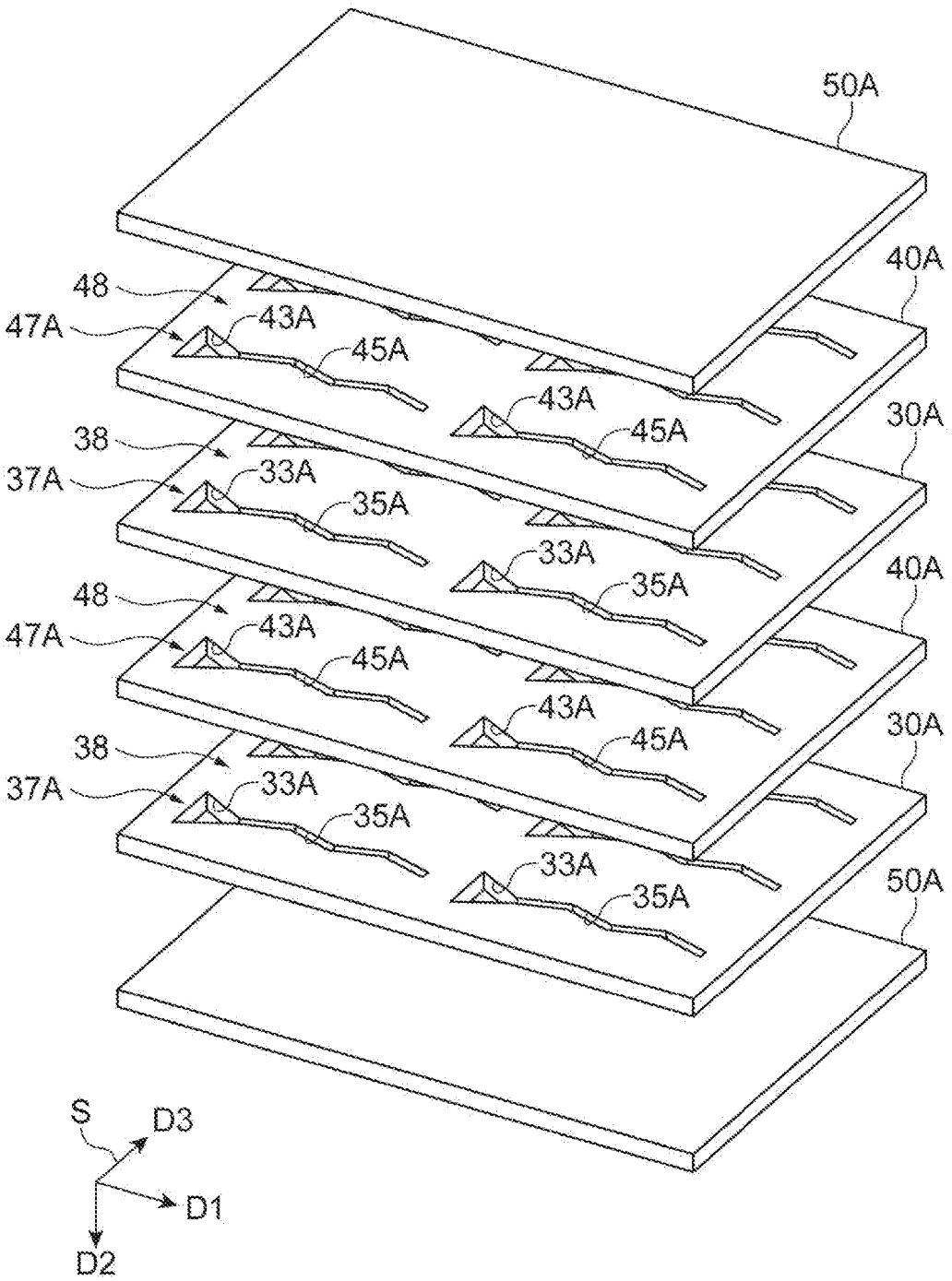
FIG. 6 is a diagram illustrating respective steps of a method of producing an electron multiplier illustrated in FIG. 1.

Next, an example of a method of producing the electron multiplier 2 will be described. FIGS. 6 to 14 are diagrams illustrating respective steps of the method of producing the electron multiplier illustrated in FIG. 1. In this method, a main body member for the main body portion 20 is first prepared (first step). This first step will be described in detail. As illustrated in FIG. 6, in the first step, a plurality of plate-shaped members 30A for the first plate-shaped member 30, a plurality of plate-shaped members 40A for the second plate-shaped member 40, and a pair of plate-shaped members 50A for the third plate-shaped member 50 are first prepared. The plate-shaped members 30A, 40A, and 50A include portions formed of a plurality of (two in this case) first plate-shaped members 30, second plate-shaped members 40, and third plate-shaped members 50 arranged in the first direction D1, respectively.

In the plate-shaped member 30A, a plurality of hole portions 33A and 35A for the hole portions 33 and 35 are formed by, for example, laser processing or punching with a die. An area between the hole portions 35A in the plate-shaped member 30A and an area outside the hole portions 35A are solid. That is, the plate-shaped member 30A includes a plurality of hole portion areas 37A in which the hole portions 35A are formed, and a plurality of solid areas 38 adjacent to the hole portion areas 37A. Here, the hole portions 33A and 35A are formed not to reach an end portion of the plate-shaped member 30A.

In the plate-shaped member 40A, a plurality of hole portions 43A and 45A for the hole portions 43 and 45 are formed by, for example, laser processing or punching with a die. An area between the hole portions 45A in the plate-shaped member 40A and an area outside the hole portions 45A are solid. That is, the plate-shaped member 40A includes a plurality of hole portion areas 47A in which the hole portions 45A are formed, and a plurality of solid areas 48 adjacent to the hole portion areas 47A. Here, the hole portions 43A and 45A are formed not to reach an end portion of the plate-shaped member 40A.

Figure 7:
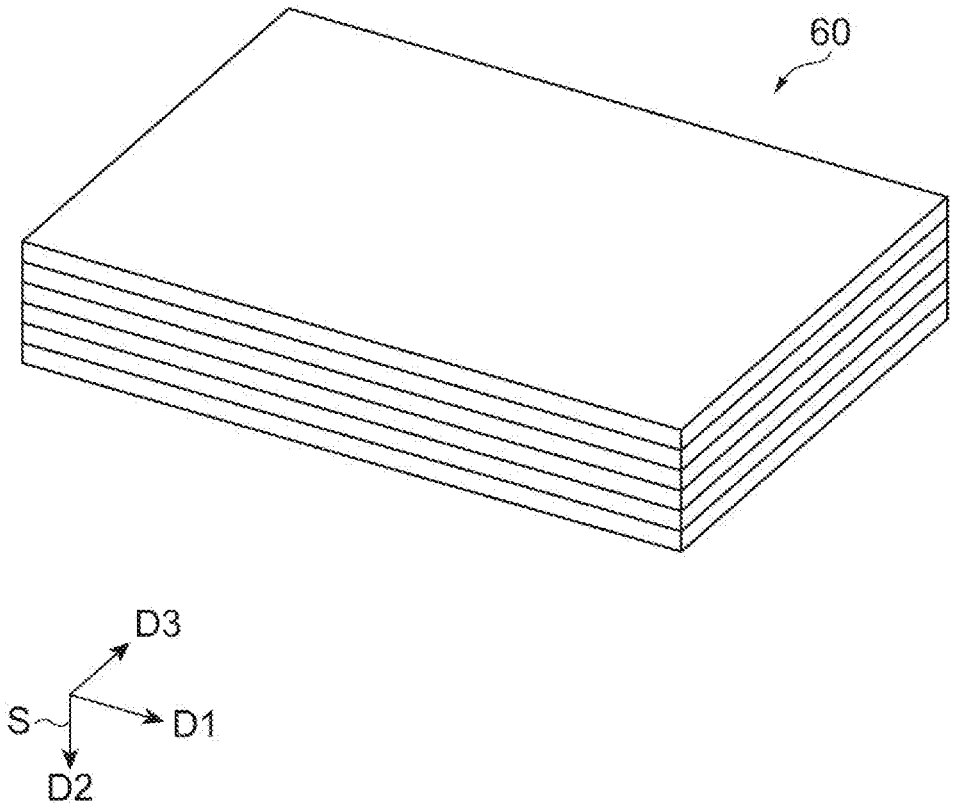
FIG. 7 is a diagram illustrating respective steps of a method of producing the electron multiplier illustrated in FIG. 1.

Subsequently, the plate-shaped member 30A and the plate-shaped member 40A are alternately stacked in the second direction D2, and the plate-shaped members 50A are arranged so that the stack of the plate-shaped members 30A and 40A is sandwiched from both sides in the second direction D2. Accordingly, a stack 60 configured of the plate-shaped members 30A, 40A and 50A is formed as illustrated in FIG. 7. In this state, the stack 60 is pressed and sintered so that the plate-shaped members 30A, 40A, and 50A are integrated with each other.

In this case, the hole portion area 37A of the plate-shaped member 30A faces the solid area 48 of the plate-shaped member 40A in the second direction D2. Further, the hole portion area 47A of the plate-shaped member 40A faces the solid area 38 of the plate-shaped member 30A in the second direction D2. Accordingly, in the stack 60, an opening in the second direction D2 of the hole portion 35A of the plate-shaped member 30A is closed by the solid area 48 of a pair of plate-shaped members 40A, or is closed by the solid area 48 of the plate-shaped member 40A and the plate-shaped member 50A.

Further, an opening in the second direction D2 of the hole portion 45A of the plate-shaped member 40A is closed by the solid area 38 of a pair of plate-shaped members 30A, or is closed by the solid area 38 of the plate-shaped member 30A and the plate-shaped member 50A. Further, the openings of the hole portions 33A and 43A in the second direction D2 are continuous between the plurality of plate-shaped members 30A and the plate-shaped member 40A and are closed by a pair of plate-shaped members 50A.

Figure 8:
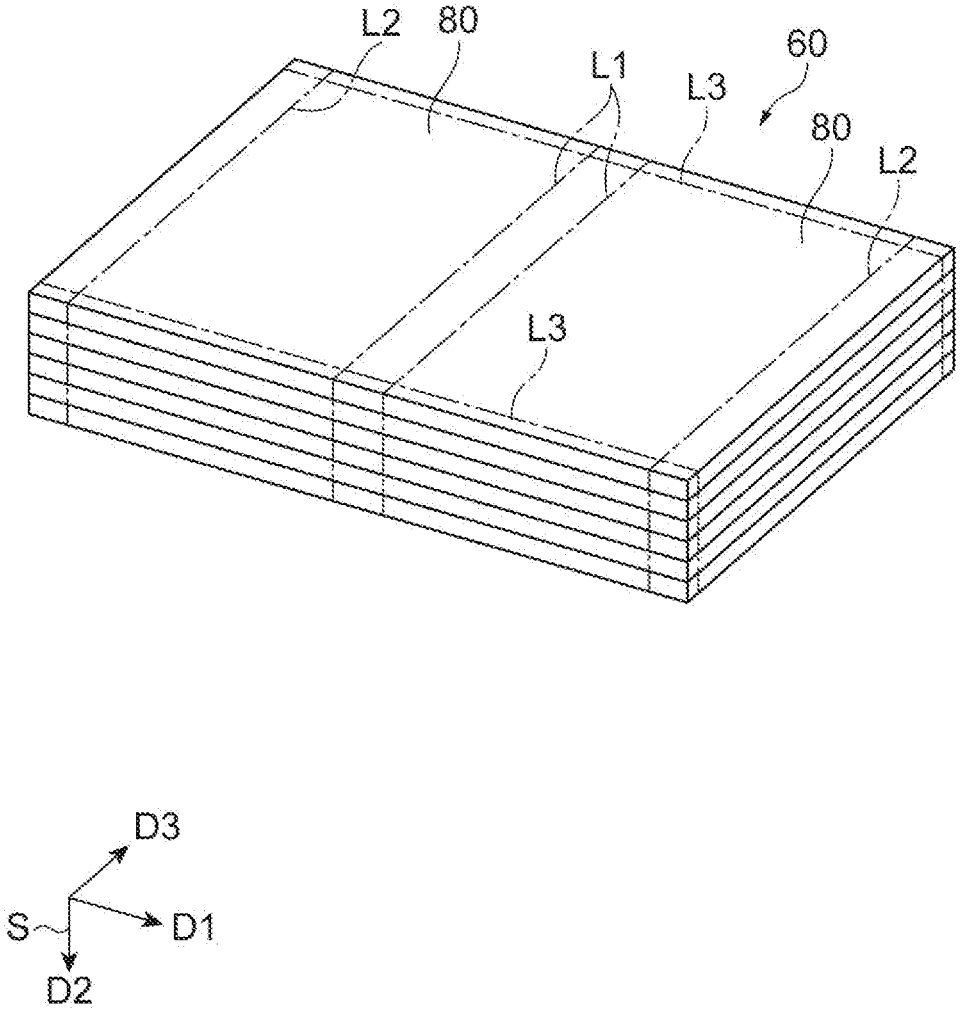
FIG. 8 is a diagram illustrating respective steps of a method of producing the electron multiplier illustrated in FIG. 1.
Figure 9:
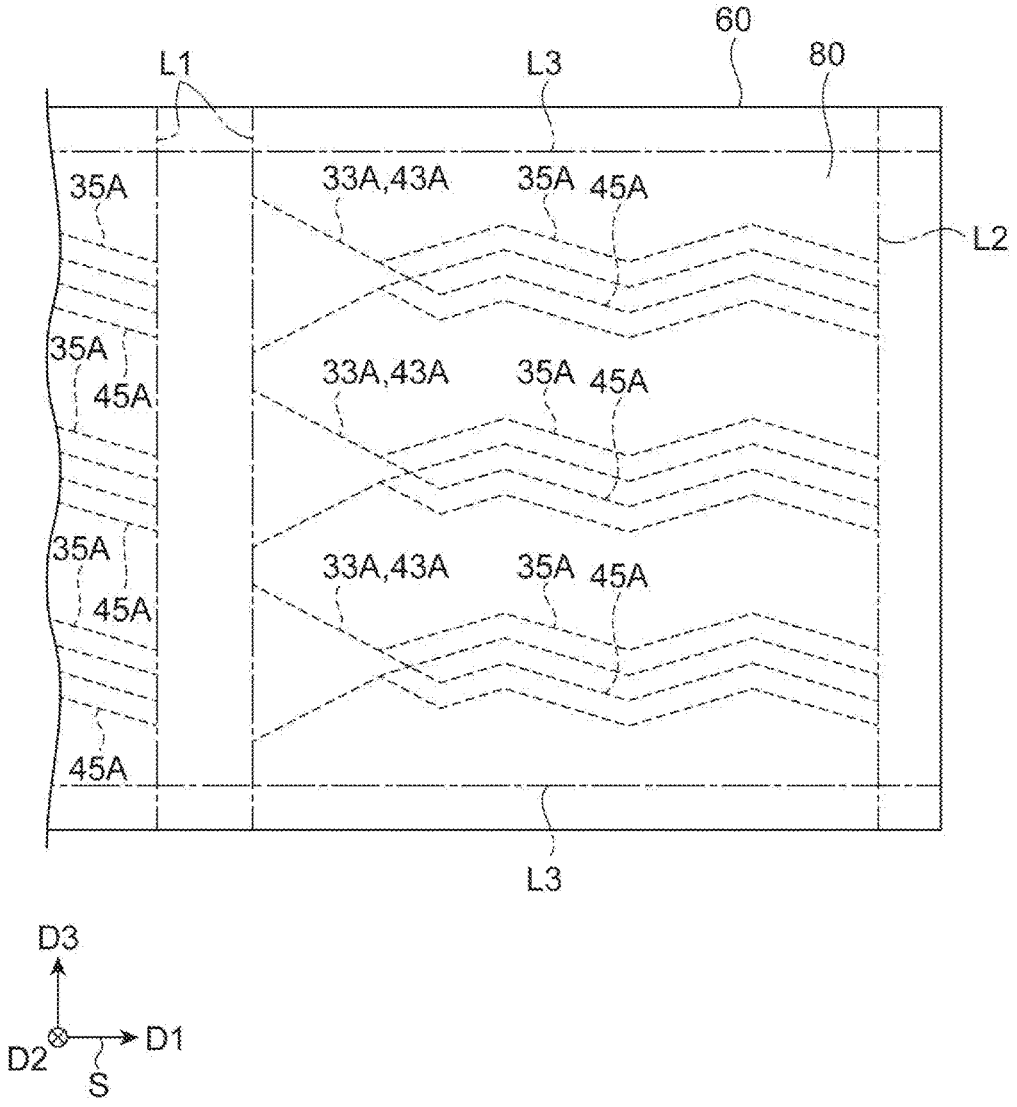
FIG. 9 is a diagram illustrating respective steps of a method of producing the electron multiplier illustrated in FIG. 1.

Subsequently, the integrated stack 60 is cut so that a plurality of (two in this case) main body members 80 are cut out, as illustrated in FIGS. 8 and 9. In this step, virtual scheduled cutting lines L1, L2, and L3 are first set. The scheduled cutting lines L1 extend linearly in the third direction D3 to pass between the main body members 80. The scheduled cutting lines L2 extend linearly along both edge portions of the stack 60 in the first direction D1. The scheduled cutting lines L3 extend linearly along both edge portions of the stack 60 in the third direction D3.

The scheduled cutting lines L1 are set such that the hole portions 33A and 43A are open at cut surfaces thereof when the cutting along the scheduled cutting lines L1 has been performed. In addition, the scheduled cutting lines L2 are set such that the hole portions 35A and 45A are open at cut surfaces thereof when cutting along the scheduled cutting line L2 has been performed. Therefore, by cutting the stack 60 along the scheduled cutting lines L1, L2, and L3, a plurality of (two in this case) main body members 80 are cut out from the stack 60. The cut surface due to cutting is the end surface 20*a* and the end surface 20*b*. Due to this cutting, the hole portions 33A and 43A are open with respect to the end surface 20*a*, and the hole portions 35A and 45A are open with respect to the end surface 20*b*.

Figure 10:
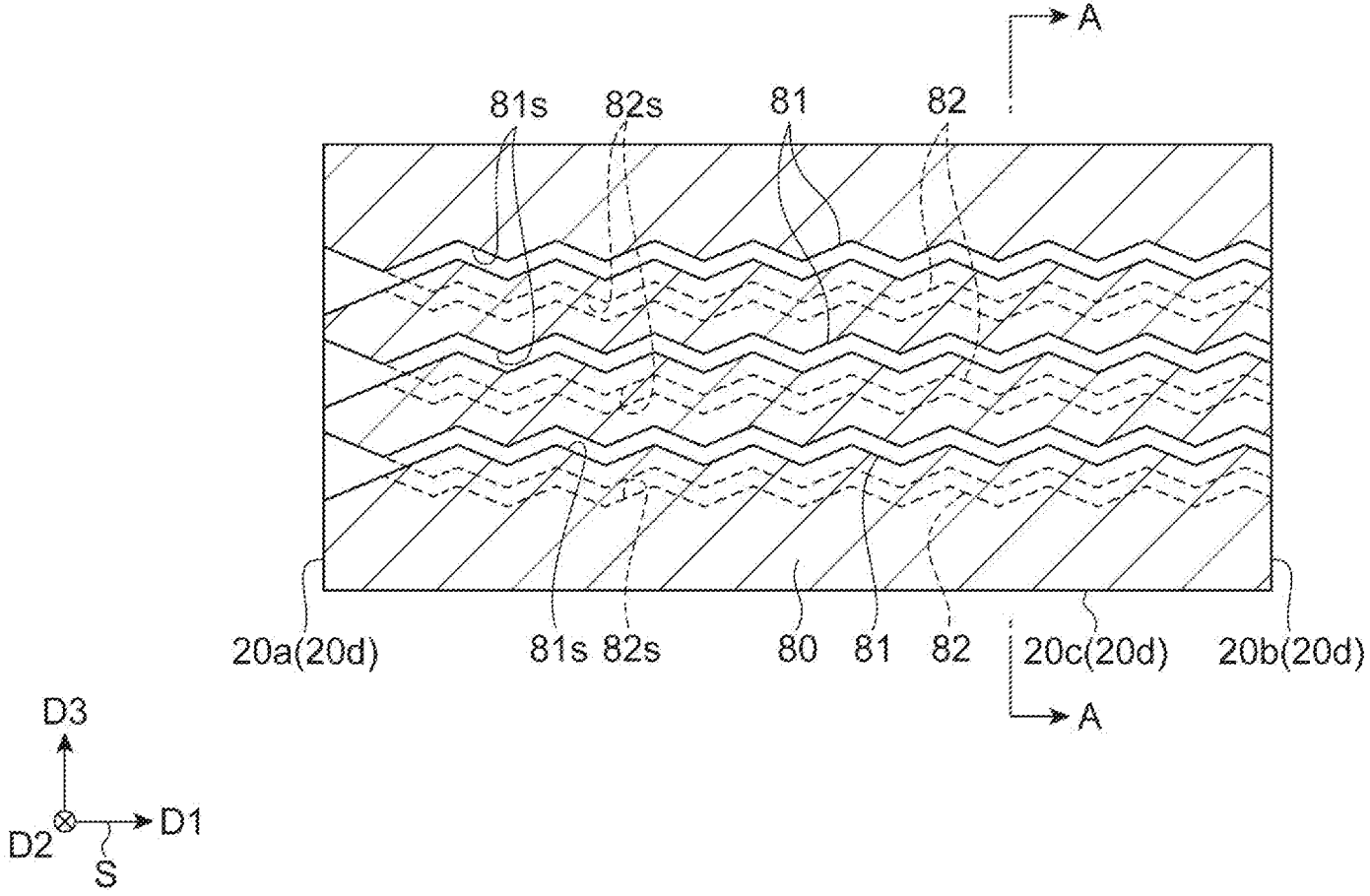
FIG. 10 is a diagram illustrating respective steps of the method of producing the electron multiplier illustrated in FIG. 1.

That is, the main body member 80 prepared in the first step includes the end surfaces 20*a* and 20*b*, as illustrated in FIG. 10. In addition, the first communicating hole 81 through which the end surface 20*a* and the end surface 20*b* communicate is formed by the hole portion 33A and the hole portion 35A in the main body member 80. The first communicating hole 81 is a hole portion which becomes the first channel 21 later (that is, a hole portion for the first channel 21). In addition, the second communicating hole 82 through which the end surface 20*a* and the end surface 20*b* communicate is formed by the hole portion 43A and the hole portion 45A in the main body member 80. The second communicating hole 82 is a hole portion which becomes the second channel 22 later (that is, a hole portion for the second channel 22).

Thus, in this first step, the main body member is prepared by stacking a plurality of plate-shaped members in which hole portions for channel are formed and a pair of solid plate-shaped members on each other and integrating the plate-shaped members. More specifically, the main body member 80 is prepared by stacking the plurality of plate-shaped members 30A in which the hole portions 33A and 35A for the first channel 21 (the first communicating hole 81) are formed and the plurality of plate-shaped members 40A in which the hole portions 43A and 45A for the second channel 22 (the second communicating hole 82) are formed on each other to close each other's hole portions, further stacking the plate-shaped member 50A to be sandwiched from both sides of the stack of the plate-shaped member 30A and the plate-shaped member 40A, integrating the plate-shaped members (in this case, by further performing cutting).

Steps subsequent to the first step will then be described. In a subsequent step, a deposition layer 85 including a resistive layer 83 and a secondary electron multiplication layer 84 stacked on the resistive layer 83 is formed on the outer surface 20*d* of the main body member 80 using an atomic layer deposition method (second step). In addition, the deposition layer 85 is formed on the inner surface 81*s* of the first communicating hole 81 and the inner surface 82*s* of the second communicating hole 82 using the atomic layer deposition method (the second step). Accordingly, the first channel 21 is formed of the first communicating hole 81 and the second channel 22 is formed of the second communicating hole 82 (the second step).

Figure 11:
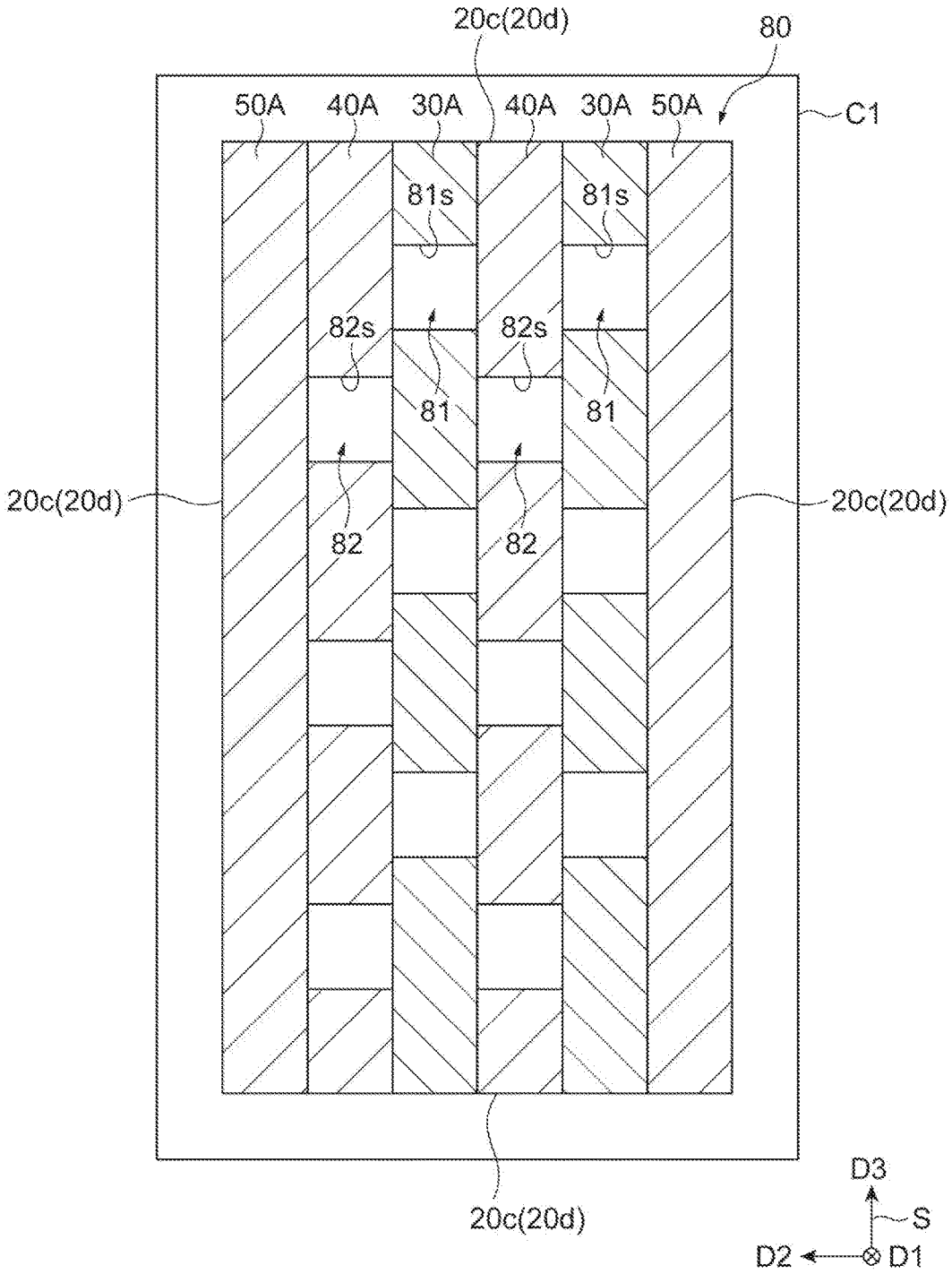
FIG. 11 is a diagram illustrating each step of the method of producing the electron multiplier illustrated in FIG. 1.
Figure 12:
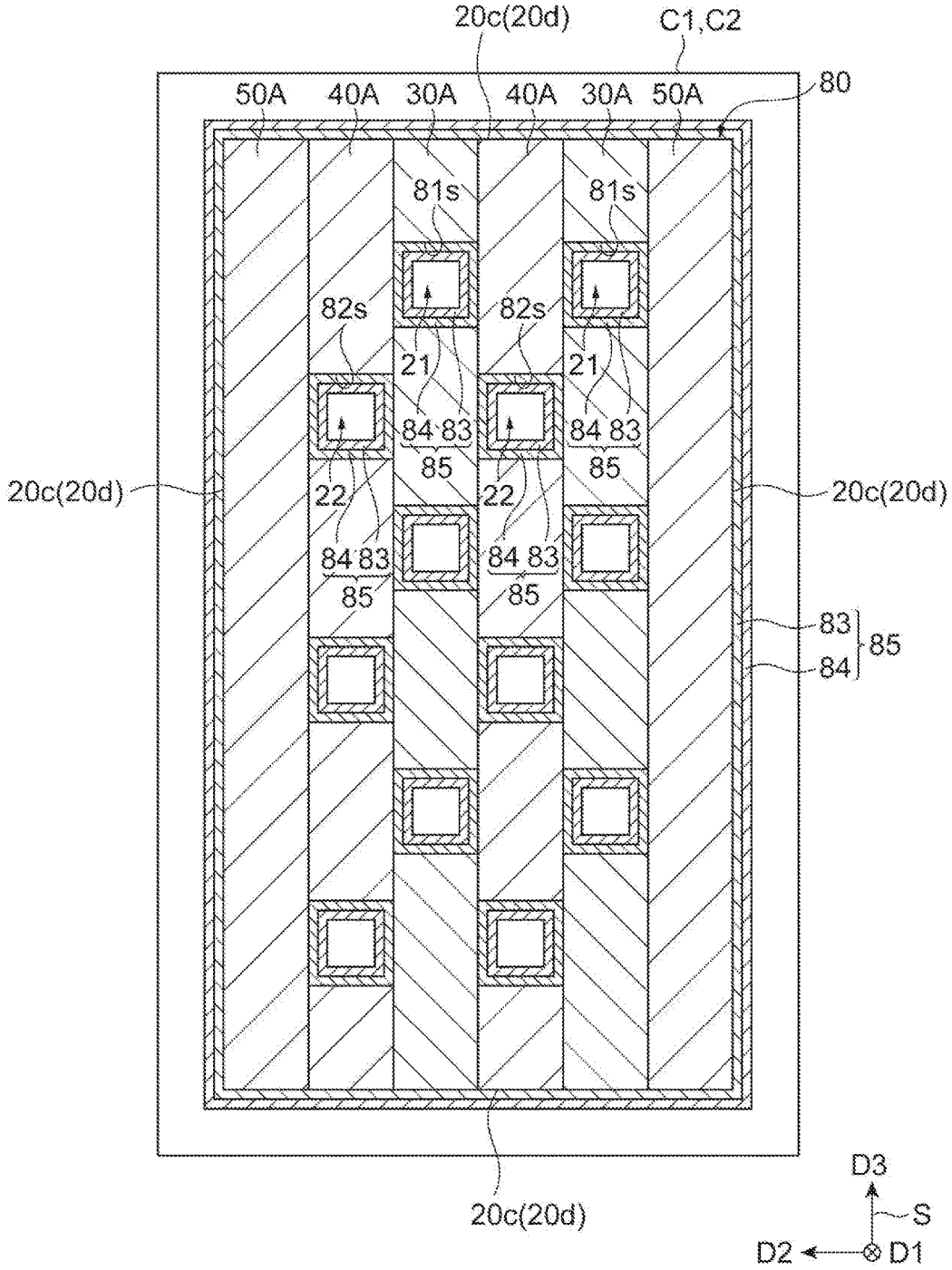
FIG. 12 is a diagram illustrating each step of the method of producing the electron multiplier illustrated in FIG. 1.
Figure 13:
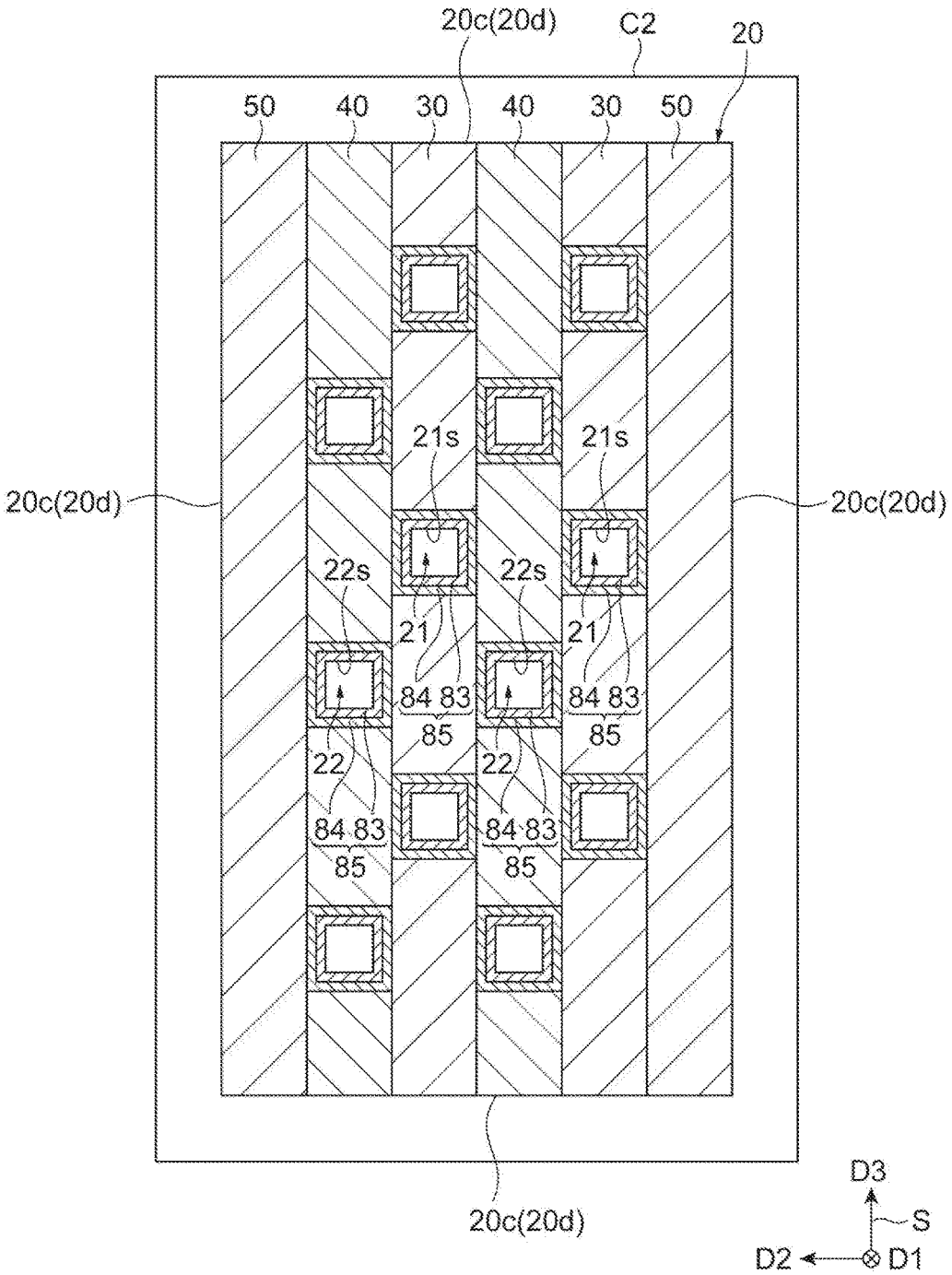
FIG. 13 is a diagram illustrating each step of the method of producing the electron multiplier illustrated in FIG. 1.

More specifically, in this second step, the main body member 80 is first accommodated in a chamber C1, as illustrated in FIG. 11. The deposition layer 85 is formed of the predetermined material described above, as illustrated in FIG. 12. Therefore, in the second step, the deposition layer 85 is formed on the entirety of the outer surface 20*d* (that is, the end surface 20*a*, the end surface 20*b*, and the side surface 20*c*) of the main body member 80, the inner surface 81*s* of the first communicating hole 81, and the inner surface 82*s* of the second communicating hole 82 all at once. It should be noted that FIGS. 11 to 13 are cross-sectional views corresponding to cross-sections taken along line A-A of FIG. 10.

In the subsequent step, the deposition layer 85 formed on the outer surface 20*d* of the main body member 80 is removed (a third step). Here, both the resistive layer 83 and the secondary electron multiplication layer 84 are removed. Further, here, the deposition layer 85 is removed by sandblasting. In sandblasting, first, the main body member 80 is accommodated in a chamber C2 and particles of about 100 μm, for example, are blown to the main body member 80, as illustrated in FIG. 12. The sandblast particles used herein are, for example, particles (for example, alumina particles) formed of the same material as that of the resistive layer 83 or the secondary electron multiplication layer 84.

In this case, the deposition layer 85 formed on the side surface 20*c* of the outer surface 20*d* of the main body member 80 is removed while the deposition layer 85 formed on the end surfaces 20*a* and 20*b* of the outer surface 20*d* of the main body member 80 is being maintained. Specifically, for example, sandblasting is performed on the main body member 80 in a state in which the end surfaces 20*a* and 20*b* (and the opening of each channel) are masked. Thus, the main body portion 20 is formed of the main body member 80, as illustrated in FIG. 13.

In a subsequent step, the heat sink 70 formed of a metal is thermally connected to the outer surface 20*d* of the main body portion 20 (a fourth step). Here, the heat sink 70 is brought into contact with the side surface 20*c* of the outer surface 20*d* of the main body portion 20 from which the deposition layer 85 has been removed, as illustrated in FIGS. 2 and 3. Through the above steps, the electron multiplier 2 is produced.

As described above, in the method of producing the electron multiplier 2, the first channel 21 and the second channel 22 are formed by forming the deposition layer 85 including the resistive layer 83 and the secondary electron multiplication layer 84 on the outer surface 20*d* of the main body member 80 for the main body portion 20, the inner surface 81*s* of the first communicating hole 81 for the first channel 21, and the inner surface 82*s* of the second communicating hole 82 for the second channel 22 using the atomic layer deposition method.

Thereafter, the deposition layer 85 formed on the outer surface 20*d* (here, the side surface 20*c*) of the main body member 80 is removed to form the main body portion 20. Therefore, even when a potential difference is applied between the end surfaces 20*a* and 20*b* at the time of an operation of the electron multiplier 2, a current is prevented from flowing to the outer surface 20*d* of the main body portion 20 via the resistive layer 83. Therefore, heat generation on the outer surface 20*d* of the main body portion 20 is suppressed. Accordingly, in the electron multiplier 2 produced using such a method, it is possible to suppress a rise in temperature at the time of the operation.

Further, in the second step of the method of producing the electron multiplier 2, the deposition layer 85 including the resistive layer 83 and the secondary electron multiplication layer 84 stacked on the resistive layer 83 is formed. Therefore, it is possible to remove the deposition layer 85 including the secondary electron multiplication layer 84 from the outer surface 20*d* while efficiently forming the deposition layer 85 including the secondary electron multiplication layer 84.

Further, in the method of producing the electron multiplier 2, the main body member 80 is formed of an insulating material. Therefore, since it is difficult for a current to flow through the main body portion 20 itself, the operation and effects obtained by removing the resistive layer 83 becomes more effective.

Further, in the third step of the method of producing the electron multiplier 2, the deposition layer 85 is removed by sandblasting. Therefore, it is possible to selectively and appropriately remove the deposition layer 85 at a desired place (for example, the side surface 20*c*) of the main body member 80 by using sandblasting.

In addition, in the method of producing the electron multiplier 2, the outer surface 20*d* of the main body member 80 includes the end surfaces 20*a* and 20*b*, and the side surface 20*c* connecting the end surface 20*a* to the end surface 20*b*. In the third step, the deposition layer 85 formed on the side surface 20*c* is removed while the deposition layer 85 formed on the end surfaces 20*a* and 20*b* is being maintained. Therefore, since it is unnecessary to perform a step of removing the deposition layer 85 on the end surface 20*a* and the end surface 20*b* at which the first channel 21 and the second channel 22 are open, an influence of the removal step on the first channel 21 and the second channel 22 can be reduced.

In addition, in the method of producing the electron multiplier 2, a fourth step of providing the heat sink 70 on the outer surface (the side surface 20*c*) of the main body portion 20 is further included after the third step. Therefore, the main body portion 20 can be cooled by the heat sink 70. Further, since the resistive layer 83 and the secondary electron multiplication layer 84 are not interposed between the side surface 20*c* of the main body portion 20 and the heat sink 70, an influence of a potential difference applied between the end surfaces 20*a* and 20*b* of the main body portion 20 on the heat sink 70 can be reduced.

In particular, the heat sink 70 is formed of a metal, and in the fourth step, the heat sink 70 is brought into contact with the outer surface 20*d* (the side surface 20*c*) of the main body portion 20. As described above, since the resistive layer 83 and the secondary electron multiplication layer 84 are not interposed between the outer surface 20*d* of the main body portion 20 and the heat sink 70, there is no concern that a current flows through the heat sink 70 due to the influence of the potential difference applied between the end surfaces 20*a* and 20*b* of the main body portion 20. Therefore, it is possible to efficiently cool the main body portion 20 by bringing the heat sink 70 formed of a metal into contact with the outer surface 20*d* of the main body portion 20.

In addition, in the electron multiplier 2, the side surface 20*c* of the main body portion 20 is exposed at least from the resistive layer 83 (here, the deposition layer 85) (that is, the resistive layer 83 is not formed on the side surface 20*c*). Therefore, even when the potential difference is applied between the end surface 20*a* and the end surface 20*b* at the time of an operation of the electron multiplier 2, a current is prevented from flowing to the outer surface 20*d* of the main body portion 20 via the resistive layer 83. Therefore, heat generation on the outer surface 20*d* of the main body portion 20 is suppressed. Therefore, according to the electron multiplier 2, it is possible to suppress a rise in temperature.

Another operation and effects of the electron multiplier 2 will be described herein. In the electron multiplier 2, the plurality of channels including the first channels 21 and the second channels 22 are provided in the main body portion 20. The main body portion 20 includes the first plate-shaped members 30 and the second plate-shaped members 40 stacked on each other. The first plate-shaped member 30 includes the hole portion areas 37 in which the hole portions 35 are formed, and the solid areas 38 adjacent to the hole portion areas 37. The second plate-shaped member 40 includes the hole portion areas 47 in which the hole portions 45 are formed, and the solid areas 48 adjacent to the hole portion areas 47. The hole portion areas 37 of the first plate-shaped member 30 face the solid areas 48 of the second plate-shaped member 40 in the second direction D2 (the stacking direction of the plate-shaped members). The hole portion areas 47 of the second plate-shaped member 40 face the solid areas 38 of the first plate-shaped member 30 in the second direction D2.

That is, at least one opening of the hole portion 35 in the second direction D2 is closed by the solid area 48 of the second plate-shaped member 40, and at least one opening of the hole portion 45 in the second direction D2 is closed by the solid area 38 of the first plate-shaped member 30. Accordingly, the first channel 21 is formed to include the inner surface of the hole portion 35 and the surface facing the inside of the hole portion 35 in the solid area 48, and the second channel 22 is formed to include the inner surface of the hole portion 45 and the surface facing the inside of the hole portion 45 in the solid area 38.

Thus, in the electron multiplier 2, the first plate-shaped member 30 contributes to the formation of the first channel 21 in the hole portion 35 and contributes to the formation of the second channel 22 in the solid area 38. In addition, the second plate-shaped member 40 contributes to the formation of the first channel 21 in the solid area 48 and contributes to the formation of the second channel 22 in the hole portion 45. Therefore, it is possible to perform multi-channelization while suppressing an increase in dead space, as compared with a case in which a single channel is formed using a pair of blocks.

Thus, in the electron multiplier 2, a heat radiation path from a heat generation place within each channel to the outside is shortened due to the reduction in the dead space. Therefore, the configuration of the electron multiplier 2 also contributes to suppression of a rise in temperature.

The embodiment of the electron multiplier production method according to an aspect of the present invention has been described. Therefore, the electron multiplier production method according to the aspect of the present invention are not limited to the method of producing the electron multiplier 2 and can be arbitrarily modified without departing from the gist of each claim.

For example, in the third step, a method of removing the deposition layer 85 formed on the outer surface 20*d* of the main body member 80 is not limited to sandblasting and may be, for example, mechanical polishing. Examples of the mechanical polishing include a polishing method using a cutting tool, a file, or the like, and a polishing method using a grinder or the like.

In addition, in the third step, when the deposition layer 85 formed on the side surface 20*c* of the main body member 80 is removed, the deposition layer 85 formed on the end surfaces 20*a* and 20*b* may not be maintained. That is, in the third step, the deposition layer 85 on the entire outer surface 20*d* of the main body member 80 may be removed all at once. Further, in the fourth step, the heat sink 70 may be formed of a material other than the metal. Alternatively, in the method of producing the electron multiplier 2, the fourth step may not be performed. That is, the heat sink 70 may not be provided on the outer surface 20*d* of the main body portion 20.

Further, in the second step of the production method, a deposition layer including only the resistive layer 83 may be formed on the outer surface 20*d* of the main body member 80, the inner surface 81*s* of the first communicating hole 81, and the inner surface 82*s* of the second communicating hole 82 using the atomic layer deposition method. In this case, in the third step, only the resistive layer 83 formed on the outer surface 20*d* of the main body member 80 is removed.

Further, in the second step of the production method, the deposition layer including only the resistive layer 83 may be formed on the outer surface 20*d* of the main body portion 20, the inner surface 81*s* of the first communicating hole 81, and the inner surface 82*s* of the second communicating hole 82 using the atomic layer deposition method, and a fifth step of forming the secondary electron multiplication layer 84 on the entirety of the outer surface 20*d* (including the side surface 20*c*) of the main body member 80, the inner surface 81*s* of the first communicating hole 81, and the inner surface 82*s* of the second communicating hole 82 may be included after the third step and before the fourth step. That is, the resistive layer 83 which is a conductive layer may not be formed on the outer surface 20*d* (particularly, the side surface 20*c*) of the main body portion 20, and only the secondary electron multiplication layer 84 which is an insulating layer may be formed.

Meanwhile, the electron multiplier production method according to the aspect of the present invention may be applied to production of another electron multiplier. An example of the other electron multiplier can include an electron multiplier including a single first channel 21 and a single second channel 22 in the third direction D3. In this case, a plurality of first channels 21 and a plurality of second channels 22 may be formed in the second direction D2. According to this electron multiplier, a dead space between electron incidence portions 23 and 24 in the third direction D3 is reduced compared with the case in which the plurality of first channels 21 and the plurality of second channels 22 are arranged in the third direction D3.

Still another electron multiplier may be an electron multiplier in which the hole portions 35 and 45 include a first portion extending in the first direction D1, a second portion extending in the third direction D3 intersecting with the first direction D1, and a third portion extending in the first direction D1. The second portion extends in the third direction D3 to connect the first portion to the third portion. According to such an electron multiplier, it is possible to lengthen the first channel 21 and the second channel 22 and increase a gain. Further, according to this electron multiplier, ion feedback in the first channel 21 and the second channel 22 is suppressed by the second portions of the hole portion 35 and the hole portion 45.

Another example of still another electron multiplier may include an electron multiplier multi-channelized by forming a channel by sandwiching a single plate-shaped member in which a hole portion has been formed, between a pair of solid plate-shaped members and arranging and integrating a plurality of sets of such plate-shaped members. Furthermore, the example may include an electron multiplier having a single channel.

INDUSTRIAL APPLICABILITY

It is possible to provide an electron multiplier production method capable of suppressing a rise in temperature, and the electron multiplier.

REFERENCE SIGNS LIST

2 Electron multiplier
20 Main body portion
20*a* End surface (one end surface)
20*b* End surface (other end surface)
20*d* Outer surface
21 First channel (channel)
22 Second channel (channel)
70 Heat sink
80 Main body member
81 First communicating hole
81*s* Inner surface
82 Second communicating hole
82*s* Inner surface
83 Resistive layer
84 Secondary electron multiplication layer
85 Deposition layer

The invention claimed is:

1. An electron multiplier production method including a main body portion, and a channel that is provided in the main body portion to open at one end surface and the other end surface of the main body portion and emits secondary electrons according to incident electrons, the method comprising:

a first step of preparing a main body member including the one end surface and the other end surface, a communicating hole for the channel through which the one end surface and the other end surface communicate being provided in the main body member;

a second step of forming the channel by forming a deposition layer including at least a resistive layer on an outer surface of the main body member and an inner surface of the communicating hole using an atomic layer deposition method; and a third step of forming the main body portion by removing the deposition layer formed on the outer surface of the main body member.

2. The electron multiplier production method according to claim 1, wherein the second step includes forming the deposition layer including the resistive layer and a secondary electron multiplication layer stacked on the resistive layer.

3. The electron multiplier production method according to claim 2, wherein the main body member is formed of an insulating material.

4. The electron multiplier production method according to claim 3, wherein the third step includes removing the deposition layer through sandblasting.

5. The electron multiplier production method according to claim 4, wherein the outer surface of the main body member includes the one end surface, the other end surface, and a side surface connecting the one end surface to the other end surface, and the third step includes removing the deposition layer formed on the side surface while maintaining the deposition layer formed on the one end surface and the other end surface.

6. The electron multiplier production method according to claim 3, wherein the outer surface of the main body member includes the one end surface, the other end surface, and a side surface connecting the one end surface to the other end surface, and the third step includes removing the deposition layer formed on the side surface while maintaining the deposition layer formed on the one end surface and the other end surface.

7. The electron multiplier production method according to claim 2, wherein the third step includes removing the deposition layer through sandblasting.

8. The electron multiplier production method according to claim 7, wherein the outer surface of the main body member includes the one end surface, the other end surface, and a side surface connecting the one end surface to the other end surface, and the third step includes removing the deposition layer formed on the side surface while maintaining the deposition layer formed on the one end surface and the other end surface.

9. The electron multiplier production method according to claim 2, wherein the outer surface of the main body member includes the one end surface, the other end surface, and a side surface connecting the one end surface to the other end surface, and the third step includes removing the deposition layer formed on the side surface while maintaining the deposition layer formed on the one end surface and the other end surface.

10. The electron multiplier production method according to claim 1, wherein the main body member is formed of an insulating material.

11. The electron multiplier production method according to claim 10, wherein the third step includes removing the deposition layer through sandblasting.

12. The electron multiplier production method according to claim 11, wherein the outer surface of the main body member includes the one end surface, the other end surface, and a side surface connecting the one end surface to the other end surface, and the third step includes removing the deposition layer formed on the side surface while maintaining the deposition layer formed on the one end surface and the other end surface.

13. The electron multiplier production method according to claim 10, wherein the outer surface of the main body member includes the one end surface, the other end surface, and a side surface connecting the one end surface to the other end surface, and the third step includes removing the deposition layer formed on the side surface while maintaining the deposition layer formed on the one end surface and the other end surface.

14. The electron multiplier production method according to claim 1, wherein the third step includes removing the deposition layer through sandblasting.

15. The electron multiplier production method according to claim 14, wherein the outer surface of the main body member includes the one end surface, the other end surface, and a side surface connecting the one end surface to the other end surface, and the third step includes removing the deposition layer formed on the side surface while maintaining the deposition layer formed on the one end surface and the other end surface.

16. The electron multiplier production method according to claim 1, wherein the outer surface of the main body member includes the one end surface, the other end surface, and a side surface connecting the one end surface to the other end surface, and the third step includes removing the deposition layer formed on the side surface while maintaining the deposition layer formed on the one end surface and the other end surface.

17. The electron multiplier production method according to claim 1, further comprising a fourth step of thermally connecting a heat sink to the outer surface of the main body portion after the third step.

18. The electron multiplier production method according to claim 17, wherein the heat sink is formed of a metal, and the fourth step includes bringing the heat sink into contact with the outer surface.

19. An electron multiplier comprising:

a main body portion including one end surface, the other end surface, and a side surface connecting the one end surface to the other end surface; and a channel provided in the main body portion to be open at the one end surface and the other end surface, wherein the channel includes a deposition layer including a resistive layer and a secondary electron multiplication layer formed on an inner surface of a communicating hole for the channel, the deposition layer is formed on the one end surface and the other end surface, the side surface is exposed at least from the resistive layer, and the deposition layer is formed using an atomic layer deposition method.

20. The electron multiplier according to claim 19, wherein the secondary electron multiplication layer is formed on the side surface.

21. The electron multiplier according to claim 19, wherein a heat sink is in contact with the side surface.

* * * * *